US007435163B2

(12) United States Patent
Natsui et al.

(10) Patent No.: US 7,435,163 B2
(45) Date of Patent: Oct. 14, 2008

(54) GRINDING SHEET AND GRINDING METHOD

(75) Inventors: Hideaki Natsui, Tokyo (JP); Makoto Saito, Tokyo (JP); Kazuya Orii, Tokyo (JP); Ryuji Fujii, Shatin (JP); Koji Hosaka, Shatin (JP)

(73) Assignees: TMP Co., Ltd., Tokyo (JP); SAE Magnetics (H.K.) Ltd., Shatin (JP); SAE Technologies (H.K.) Ltd., Shatin (JP)

( * ) Notice: Subject to any disclaimer, the term of this patent is extended or adjusted under 35 U.S.C. 154(b) by 0 days.

(21) Appl. No.: 11/708,193

(22) Filed: Feb. 20, 2007

(65) Prior Publication Data

US 2007/0232200 A1 Oct. 4, 2007

(30) Foreign Application Priority Data

Mar. 31, 2006 (JP) ..... 2006-097354

(51) Int. Cl.
*B24B 1/00* (2006.01)

(52) U.S. Cl. ..... 451/59; 451/41

(58) Field of Classification Search ..... 451/59, 451/526–539, 41, 28

See application file for complete search history.

(56) References Cited

U.S. PATENT DOCUMENTS

| | | | | |
|---|---|---|---|---|
| 6,645,061 | B1 * | 11/2003 | Bennett et al. | 451/527 |
| 6,749,485 | B1 * | 6/2004 | James et al. | 451/41 |
| 7,070,480 | B2 * | 7/2006 | Moon et al. | 451/36 |
| 7,121,938 | B2 * | 10/2006 | Suzuki | 451/527 |

FOREIGN PATENT DOCUMENTS

| | | |
|---|---|---|
| JP | 11-302636 | 11/1999 |
| JP | 2000-87011 | 3/2000 |
| JP | 2001-200244 | 7/2001 |
| JP | 2000-103470 | 4/2003 |

* cited by examiner

*Primary Examiner*—Dung Van Nguyen
(74) *Attorney, Agent, or Firm*—Wood, Phillips, Katz, Clark & Mortimer

(57) ABSTRACT

The present invention provides a grinding sheet wherein the width of the ridge in the pattern of abrasive layer is larger than the width of the recess formed between the adjacent portions of the ridge. Its shape is suitable to carry out uniform treatment without causing the workpiece to drop into the recess between ridge portions of the pattern of abrasive layer even when the workpiece is swung while the grinding sheet is rotated during grinding operation.

6 Claims, 2 Drawing Sheets

GRINDING SHEET AND GRINDING METHOD

PRIOR ART

The present invention relates to a grinding sheet and a method for grinding electronic parts, optical parts, particularly a composite material composed of a plurality of materials having different hardness from each other. More particularly, the present invention relates to a grinding sheet and a grinding method which are advantageously used to grind an air-bearing surface (ABS) of a thin film magnetic head.

BACKGROUND

Main stream of magnetic heads mounted on a hard disc drive of a computer are thin film magnetic heads such as composite MR-inductive type heads in which inductive elements are used to write records and MR (magnetoresistive) elements or GMR (giant MR) elements are used to read records.

As shown in JP 2001-20044A, these thin film type magnetic heads are composed of a composite material comprised of a plurality of materials which have different hardness, for example, a substrate such as ALTIC ($Al_2O_3$—$TiO_2$), a ceramic protective and/or insulation film such as alumina ($Al_2O_3$), and a metallic film which is a magnetic material such as permalloy (Fe—Ni) and Sendust (Fe—Al—Si) and the like.

In the process of producing thin film magnetic heads, a bar having a row of sliders is cut out from a wafer in which a number of electromagnetic transducing elements are arranged in the form of a matrix and an area of the surface of the bar that becomes ABS (air bearing surface) is lapped to obtain a flat surface.

The conventional grinding process of ABS of a slider is conducted while controlling the throat height (TH) and MR height.

The TH is one of the factors which affect recording performance of the thin film magnetic head and is a distance at a magnetic pole portion between the ABS and the terminus of the insulator which electrically isolates a thin film coil (TH shown in FIG. 3)

The MR height (MR-h) is one of the factors which affect reading performance of the thin film magnetic head and is a length of the MR element measured from the ABS (indicated as MR-h in FIG. 3). The details are described in JP2001-200244 A. In FIG. 3, the respective parts are as follows. 1: an ALTIC substrate, 2: an alumina insulation film, 3: a bottom shield film (Sendust, permalloy or the like), 4: an alumina film, 5: an MR element, 6: an alumina film, 7: a head shield film (permalloy or the like), 8: an alumina film, 9: write pole tip (permalloy or the like), 10: an alumina protective film, and 11: a coil conductor.

Conventionally, the lapping treatment of the surface which would become the ABS was performed by dripping a free abrasive slurry composition using diamond abrasive particles onto a face plate formed from a soft metal such as tin, and reciprocating a workpiece (which may be cut into a bar if necessary) to be polished on the face plate.

For examples, patent documents 1 and 2 disclose free abrasive slurry compositions suitable to form a flat surface which is to be used as ABS of thin film magnetic heads.

However, during the grinding operation using such free abrasive slurry composition, it was necessary to continue supplying the slurry composition without cessation and thus the consumption of the slurry composition was enormous, the cost was high and a particle problem that the abrasive particles pierce the surface to be polished occurred.

On the other hand, during the finish grinding operation of surfaces or end faces of precision parts, it is possible to use a grinding or polishing sheet which is composed of an abrasive layer formed on a substrate sheet. Since the grinding sheet retains fixed abrasive particles and accordingly any expensive free slurry composition is not necessary, one sheet may be used repeatedly. Therefore, the production cost can be reduced. For example, patent document 3 discloses a grinding sheet adapted to be used to finish surfaces or end faces of precision parts.

[Patent document 1] JP 11-302636 A

[Patent document 2] JP 2000-087011 A

[Patent document 3] JP 2003-103470 A

DESCRIPTION OF THE INVENTION

Problem to be Solved by the Invention

Patent document 3 discloses a grinding sheet in which partial recesses are formed in an abrasive layer, wherein the arbitrary pattern of the abrasive layer which is necessary for grinding operation, is formed on one surface of a substrate film.

The partial recesses formed in the abrasive layer of the grinding sheet are provided to prevent a liquid lubricant in aqueous or oily form, which is dripped during the grinding operation, from flowing to unnecessary areas or to cause the liquid lubricant to flow uniformly over the surface of the abrasive layer.

However, if the partial recesses such as concentric circles or polka dot pattern are formed in the abrasive layer, drainage of the liquid lubricant is hindered and chips or debris formed from grinding stay on the ground surface. Also, in radial or spiral pattern, the linear directions of the recesses are almost in parallel to a workpiece to be ground, causing damages to the workpiece. As a result, such problems as scratching to the surface to be ground, reduction of grinding rate, and further lowering of the durability of the grinding sheet are caused. Coping with such problems, the present invention provides a grinding sheet which has little damage to the workpiece, has a high grinding rate and excels in durability.

More specifically, the direction of relative movement of the grinding sheet and the workpiece to be ground is in such relationship that the grinding sheet is rotated while the workpiece is fixed or swung in radial direction. Accordingly, in the case of radial or spiral pattern, the line direction of the recesses of the abrasive layer works in parallel to the workpiece to be ground. That cause problems such as the workpiece drops in the recesses of the abrasive layer.

Means for Solving the Problem

The present invention provides a grinding sheet comprising a substrate sheet and an abrasive layer pattern formed as a ridge on at least one surface of the substrate sheet, characterized in which the abrasive layer pattern is constituted as a single plane curve pattern in which the ridge extends spirally around a center of the substrate and continuously away from the center. The spiral curve pattern (or a groove formed in the abrasive layer) of the abrasive layer pattern acts on the workpiece in the direction normal to the direction of the spiral curve pattern, so that the damage to the workpiece to be ground is minimized and an aqueous or oily liquid lubricant dripped onto the abrasive layer during abrasion operation is uniformly distributed over the abrasive layer and, at the same time, the debris to grind are efficiently removed or drained from the ground surface.

According to one of the embodiments, the present invention provides a grinding sheet wherein the width of the ridge in the pattern of an abrasive layer is larger than the width of the recess formed between the adjacent portions of the ridge. This is an appropriate shape in order to carry out uniform treatment since the workpiece does not drop into the recess between ridge portions of the pattern of abrasive layer even when the workpiece is swung while the grinding sheet is rotated during grinding operation.

According to another embodiment, the present invention provides a grinding sheet wherein an adhesive layer is formed on the surface opposite to the surface where the abrasive layer pattern is formed. With the construction, the grinding sheet can be attached to a face plate which is used in the conventional diamond slurry-type grinding machine, thus abrasive operation can be performed without modifying the structure of the machine. Accordingly, the conventional adjusting method of MR height etc by the adjustment of the number of revolutions of face plate or by the adjustment of load exerted on the ABS, can be utilized while grinding the ABS surface of thin film magnetic head sliders.

Further the present invention provides a method for grinding a workpiece while rotating the grinding sheet. The method of the present invention is characterized in that the direction of rotation of the grinding sheet is set in the same direction as the spiral pattern which extends spirally around a center of the substrate and continuously away from the center. This method, as compared with the conventional method using an abrasive sheet covered with an abrasive layer all over the surface, is an appropriate method, since the abrasive layer acts efficiently on the workpiece to be ground and the debris generated by grinding are efficiently drained together with the liquid lubricant although the effective abrasive area decreases.

Further, the present invention provides a grinding method, characterized in that the width of the ridge of the abrasive layer pattern is wider than the area to be ground of the workpiece and the recess (where the abrasive layer pattern is absent) between the ridge portions of the abrasive layer pattern is narrower than the size of the area to be ground of the workpiece. This method can make the area to be ground of the workpiece sufficiently contacted with the ridge of the abrasive layer pattern even if the workpiece is swung and can prevent the workpiece from dropping in the recess because the spirally extending abrasive pattern constantly acts in the direction normal to the workpiece movement during the grinding operation.

For the reason, the grinding method of the present invention can be advantageously used for the process of thin film magnetic heads, in which a wafer consisting of a substrate plate such as an ALTIC and a number of electromagnetic transducer elements in the form of a matrix formed on the substrate is diced into bars. A plurality of sliders arranged in a row where the surface of the slider being destined to be the ABS of is subjected to lapping operation to make the surface flat.

EFFECTS OF THE INVENTION

If the grinding sheet of the present invention is used for grinding or lapping a surface to be used as an ABS of thin magnetic heads, the grinding capability would be high and the MR height can be stable the capacity of the grinding might be decreased due to decrease in the effective area for grinding if the abrasive layer is patterned. However, because of efficiently draining the heavily contaminated mixture of lapping oil and generating debris by the grinding operation, it is expected that a cleaned surface of the abrasive layer always can be gotten and act effectively on the workpiece.

The method of using the grinding sheet according to the present invention is useful for any conventional slurry type grinding machine as it is and thus introduction of a new apparatus or modification of the slurry type grinding machine is not necessary and thus cost-effective. Additionally, using the conventional slurry type grinding machine, the face plate is sometimes damaged by clash of workpiece and thus the face plate has to be refined to be flat before every use.

According to the present grinding sheet, it is sufficient only to replace the grinding sheet with a new one and thus the working efficiency is also superior.

BEST MODE OF WORKING THE INVENTION

Embodiments of the present invention will be explained in detail.

FIG. 1 is a plan view showing one embodiment of the grinding sheet 12, and FIG. 2 is a cross-section view along the line A-A of FIG. 1.

The grinding sheet 12 of the present invention is comprised of a substrate sheet 13 and an abrasive layer pattern consisting of a ridge 15 on at least one surface of the substrate with or without an intervening anchor layer 14. An adhesive layer 17 may be provided on the rear surface of the substrate 13. A recess 16 is formed between the ridge portions 15. According to FIG. 1, the abrasive layer pattern is formed by a single plane curve pattern extending spirally (clockwise in this example) around the center of a donut-shaped substrate sheet 12 and continuously going apart from the center. Accordingly the recess 16 is also spiral sulcus. The direction of this pattern is clockwise direction which conforms to the direction of the curve pattern of the grinding sheet with the surface of the abrasive layer of the grinding sheet 12 being in contact with the workpiece.

The width "a" of the ridge of the abrasive layer pattern is wider than the width "b" of the groove formed between the ridge portions. It is preferred that the width of the ridge is wider than the area to be ground of the workpiece and the width of the groove formed between the ridge portions is narrower than the area to be ground of the workpiece. The width of the recess is preferably ½ or less and 1/10 or more of the width of the ridge. Although the recess, where abrasive layer is absent, formed between the ridge portions depends on the area to be ground of the workpiece, the width of the ridge is preferably about 1-10 mm, the width of the recess is preferably about 0.1-5 mm for grinding the ABS of thin film magnetic heads in the manufacturing process. More preferably, the width of the ridge is 3.0±1.0 mm and the width of the recess is 0.5±0.2 mm.

With the construction, even if a pico-slider having a dimension of 1.00 mm wide and 1.25 mm long or a femto-slider of 0.7 mm wide and 0.85 mm long, which are mainstreams of the current thin film magnetic heads, are swung or shuffled on the abrasive layer pattern which is rotated in spiral fashion, the sliders do not fall into the step or the groove between the ridge portions and thus a plurality of thin film magnetic heads can be uniformly ground, since the ridge of the pattern is still larger than the area to be ground of the slider and the recess formed between the ridge portions is smaller than the width of the slider.

In FIG. 1, the grinding sheet is in the form of a donut, which is a convenient shape for rotating the grinding sheet, uniformly spreading the liquid lubricant, and enhancing the drainage of the debris or particles from grinding. However, any shape may be adopted depending on the shape of the workpiece to be ground or the grinding machine or apparatus.

The substrate sheet of the present invention may be appropriately selected so long as it has a sufficient strength during the grinding operation, a heat resistance during treatment of the grinding sheet, and a sufficient handling performance during boding operation. More specifically, polyolefin films such as polyethylene and polypropylene; polyester films such as polyethyleneterephthalate and polyethylene naphthalate; acryl resin; polyacrylate film, polyvinylchloride film, polycarbonate film are useful for the substrate sheet. To prevent adhesion of dusts during the production process, films to which electric conductivity or antistatic property has been imparted may be used. The thickness of the substrate sheet may be appropriately selected from the aspects of the workability during its producing and bonding operations and the grinding performance, but is generally in the range of 10-300 μm, preferably 50-150 μm.

The abrasive layer is mainly comprised of abrasive particles and a binder resin and the thickness of the abrasive layer is 1-50 μm, preferably 3-15 μm.

As abrasive particles, silica, alumina, silicon carbide, diamond, iron oxide, chromium oxide, zirconium oxide, cerium oxide, titanium oxide, silicon nitride, antimony oxide, boron nitride and lithium silicate may be used alone or in combination of them. Diamond particles are particularly suitable because the surface which becomes the ABS is made of a hard material such as an AlTiC. The average particle size of the abrasive particles is 0.05-15 μm.

As the binder, synthetic resin such as polyurethane resin, polyester resin, polyester-urethane resin, phenol resin, vinylchloride resin, acrylic resin, and epoxy resin may be used.

The weight ratio of the abrasive particles contained in the abrasive layer is 1/1-10/1 (abrasive particles/binder resin), preferably 2/1-4/1.

To improve wear resistance, solvent resistance and heat resistance, a curing agent may be added to the abrasive layer. For example, isocyanate curing agent such as tolylenediisocyanate (TDI), xylenediisocyanate (XDI), dicylohexylmethane-4,4'-diisocyanate (HMDI), hexamethylenediisocyanate (HDI), isophoronediisocyanate (IPDI) as curing agent may be used. The amount of the curing agent is 0.5-100 wt %, preferably 3-30 wt % against the total amount of the binder resin.

Moreover the abrasive layer may contain other kinds of additives such as conductivity imparting agent, plasticizer, anti-oxidant, coloring agent, filler, thickener.

While the surface which becomes an ABS of a thin film magnetic head is treated, the process need to prevent any electrostatic discharge (ESD). Therefore, carbon black is added as a conductivity-imparting agent during the process. The amount of addition is usually 5-50 wt % on the basis of the total amount of the solid contents of the binder resin, depending on the types of carbon black.

As the process for producing the abrasive layer, abrasive particles, a binder resin, an organic solvent, and necessary additives are blended to form a coating composition for the abrasive layer. For example, the abrasive particles and the binder are added to the organic solvent (as a dispersing medium), and are homogeneously dispersed with use of a dispersing machine such as sand mill and thereafter a curing agent or other necessary additives are added so that the final composition is attained.

Next, as a method for forming a desired abrasive layer pattern, screen printing, gravure printing or gravure offset printing may be adopted, and particularly preferred is screen printing.

When the abrasive layer pattern is formed by screen printing method, an organic solvent which is used for preparing the coating composition for the abrasive layer, such as isophorone, cylrohexane, methylethylketone, methylisobutylketone, methanol, ethanol, methylacetate, ethylacetate, toluene, xylene or mixture of at least two of them may be used to appropriately adjust the printing properties such as the ink viscosity, drying speed, etc.

An anchor layer between the substrate sheet and the abrasive layer may be used for the adhesion of the abrasive layer to the substrate material, for the draining property of the oil and for the electrical conductivity to suppress ESD. The anchor layer is formed from a binder resin as main component and additive and curing agent may be added if necessary. Synthetic resin such plastic as polyurethane resin, polyester resin, polyester urethane resin, phenol resin, vinyl chloride resin, acrylic resin and epoxy resin can be used as the binder resin. A conductivity-imparting agent, plasticizer, anti-oxidant, colorant, filler and thickener may be used as additives. To prevent ESD, a carbon black is added as an electric conductivity-imparting agent, the amount of which depends on the oil absorption property of the carbon black but usually 5-50 wt % on the basis of the total amount of the binder resin. As the curing agent, isocyanate curing agent such as tolylenediisocyanate (TDI), xylenediisocyanate (XDI), dicylohexylmethane-4,4'-diisocyanate (HMDI), hexamethylenediisocyanate (HDI), isophoronediisocyanate (IPDI) may be used. The amount is 0.5-100 wt %, preferably 3-30 wt % based on the total amount of the binder resin. The thickness of the anchor layer is 0.05-10 μm, preferably 0.5-5.0 μm.

An adhesive layer may be formed directly or with an interposing anchor layer on the other surface of the substrate sheet. Any kind of adhesive as the adhesive layer may be used so long as the grinding sheet can be fixed on a grinding or lapping machine. For example, an adhesive of sticky type, thermal plastic type, thermosetting type or UV curing type, such as acryl, polyurethane, epoxy and polyester systems, etc. can be used. In this case, as for the organic solvent, the printing property such as ink viscosity and dry characteristic etc. can be adjusted by making use of alcohol, ketone, amine, ester, ether or hydrocarbon and the like. The method for forming the adhesive layer may be selected from any kind of the conventional coating methods such as nozzle coating, gravure coating, dipping coating, spin coating, bar coating and blade coating, and printing method such as screen printing, gravure and gravure offset printing. Alternatively, a laminating method may be adopted wherein an adhesive layer is formed on another substrate other than the grinding sheet, and bonding the sheets together, to thereby decal-transfer the adhesive layer to the substrate sheet. Film thickness of the adhesive layer is not particularly limited, but 0.1 μm to 50 μm is preferred.

On the surface of the adhesive layer, a peel film may be attached for protection of the adhesive layer. The peel film may be selected from polyethyleneterephthalate, polypropylene, polyethylene, polycarbonate, polymethylmethacrylate. The thickness of the peel film is not particularly restricted but 1-100 μm is preferred.

EXAMPLES

One example of the grinding sheets of the present invention will be explained in detail. The grinding sheets of the example consist of a structure of peel film/adhesive layer/substrate sheet/anchor layer/abrasive layer.

(Preparation of Grinding Sheets)

Polyethyleneterephthalate film (S-10 manufactured by Toray K.K.) having a thickness of 125 μm was used as a substrate sheet.

An anchor layer was prepared by a polyester (Vylon 290, manufactured by Toyo Boseki K.K.) as a binder, polyisocyanate curing agent (Colonate HL, manufactured by Nippon Polyurethane) as a curing agent, carbon black (BP2000, manufacture by Cabot Co.) as a conductivity-imparting agent, and a mixture of cylcohexanone and high boiling point hydrocarbon (Solvesso 150, manufactured by Asahi Kasei Chemicals K.K.) as a solvent. Table 1 shows the formulation of the prepared anchor layer coating material. The anchor layer coating was printed on the entire surface of the substrate sheet using a screen printing method to obtain a coating in the thickness of 1.5-3.0 μm.

The surface resistance of the substrate sheet was measured using a Surface Electrical Resistance Measurement Device R8340 manufactured by Advantest K.K. and the result was $10^4$-$10^8$ Ω/sq-cm.

TABLE 1

| Ingredients | Parts by weight |
|---|---|
| Polyester | 40 |
| Carbon black | 6 |
| Polyisocyanate | 4 |
| Solvent | 50 |
| Total | 100 |

The coating composition for abrasive layer was prepared by using a synthesized diamond powder having $D_{50}$ of about 0.80 μm as grinding particles, a polyester (Vylon 290, manufactured by Toyo Boseki K.K.) as a binder resin, a polyisocyanate curing agent (Colonate HL, manufactured by Nippon Polyurethane) as curing agent, carbon black (BP2000, manufacture by Cabot Co.) as a conductivity-imparting agent, and a mixture of cylcohexanone and high boiling point hydrocarbon (Solvesso 150, manufactured by Asahi Kasei Chemicals K.K.) as a solvent. Table 2 indicates the formulation of the abrasive layer coating material.

| Ingredients | Parts by weight |
|---|---|
| Diamond abrasive | 33 |
| Polyester | 10 |
| Carbon black | 1 |
| Polyisocyanate | 1 |
| Solvent | 55 |
| Total | 100 |

The abrasive layer coating materials for Example and Comparative Example were prepared by the screen method wherein various pattern of the abrasive layer are printed onto the anchor layer to have a thickness of 7.0-8.0 μm. The surface resistance of the grinding sheet was $10^4$-$10^8$ ·Ω/sq-cm.

The patterns of the abrasive layers of the examples and the comparative examples will be explained.

The pattern of the abrasive layer for Example 1 is a spiral pattern extending in the clockwise direction from and around the center of the substrate sheet. The thickness of the abrasive layer was 7.5 μm, the width of the ridge was 3.0 mm and the width of the groove was 0.5 mm.

Comparative Example 1 was a grinding sheet having a flat structure consisting of a substrate sheet on which a uniform abrasive layer is formed in the thickness of 7.5 μm.

To compare to the conventional methods, Comparative Examples 2-4 were prepared which have various patterns of abrasive layers.

The grinding sheet of Comparative Example 2 had a pattern of abrasive layer in the form of concentric circles around the center of the substrate sheet.

The grinding sheet of Comparative Example 3 had a pattern of abrasive layer similar to Example 1 except that the direction of the spiral is opposite to that of Example 1. The thickness of the abrasive layer was 7.5 μm, the width of the ridge of the abrasive layer was 3.0 mm and the width of the recess was 0.5 mm.

The grinding sheet of Comparative Example 4 had a spiral pattern in the clockwise direction as in Example 1, except that the width of the ridge was 0.5 mm, the width of the recess was 0.5 mm, and the thickness of the abrasive layer was 7.5 um.

The adhesive layer was prepared by printing a CAT-1300S adhesive (manufactured by Teikoku Printing Inks Mfg. Co) with the thickness of 6.0-8.0 μm on the substrate sheet on the side opposite to the abrasive layer by screen printing method. After printing, a peel film is laminated on the adhesive layer.

After forming the grinding sheets provided with all the layers, they were cut into doughnut shape having an outer diameter of 400 mm and an inner diameter of 205 mm to produce respective grinding sheets of the Example and Comparative Examples.

(Grinding Tests)

Grinding tests were performed by using a bar which had been cut out from a wafer as a bar in which a row of magnetoresistive elements were arranged and the surface area which was expected to be the ABS was ground.

The grinding operation was performed by an automatic lapping machine which can monitor the MR height wherein each of the grinding sheets of Example and Comparative Examples was adhered to a face plate made of tin and the grinding operation was performed.

The grinding operation was performed under the conditions that the tin face plate was rotated in the clockwise direction at 60 rpm, while feeding a lapping oil of hydrocarbon solvent for 3 seconds each at intervals of 30 seconds.

(Evaluation of Grinding Sheets)

The evaluation was effected with respect to the ground quantity per unit time, the uniformity of the MR height, the flatness of the ABS surface, the condition of the lapping oil drainage, and the durability of the grinding sheet.

The ground quantity per unit time was indicated as relative value relative to the ground quantity by the abrasive sheet in Example 1 being 1.00.

The uniformity of the MR height was evaluated by the standard deviation of the MR height of the magneto-resistive elements.

The flatness of the ABS was measured using an interference optical microscope. High flatness is indicated by single circle and unacceptable one is indicated by cross.

The durability was evaluated by the number of bars lapped with use of a single grinding sheet. When the grounding quantity, the uniformity or the flatness dropped down to 60% of those values of the first bar, the number of bars counted from the first to the last bars was used as the durability. Durability over 100 bars is indicated by double circle, durability of at least 75 is indicated by single circle, 50 or less is indicated by triangle, and less than 30 is indicated by cross.

The drainage of the lapping oil is observed visually.

The result is indicated in Table 3.

TABLE 3

| | Ground Quantity | MR Height Uniformity σ | Flatness | Oil Drainage | Durability | Total Evaluation |
|---|---|---|---|---|---|---|
| Example 1 | 1.00 | 0.078 | ○ | Good | ◎ | ◎ |
| Comp. Ex. 1 | 0.65 | 0.145 | X | Residual oil on the sheet | X | X |
| Comp. Ex. 2 | 0.80 | 0.045 | X | Residual oil on the sheet | Δ | X |
| Comp. Ex. 3 | 0.80 | 0.215 | ○ | A slight residual oil | Δ | Δ |
| Comp. Ex. 4 | 0.75 | 0.47 | ○ | Good | ○ | Δ |

As a result, it is confirmed that the grinding sheet according to Example 1 has a large grinding capacity, a high MR height of the magneto-resistance element, and a high flatness in the area which becomes ABS. In contrast, the flat structure of Comparative Example 1 has a low grinding capacity. That is due to a low lapping oil drainage which causes clogging of the recess with debris, leading to such a low grinding capacity and a low durability.

Similarly, in the case of the concentric pattern of Comparative Example 2, the drainage of the oil is better than Comparative Example 1 but the oil containing debris from grinding cannot be drained and is retained in the recess and thus the flatness and the durability are inferior to Example 1.

Comparative Example 3 has a spiral structure in the direction opposite to that of the revolution of the face plate and thus damage to the workpiece is large, resulting in a poor uniformity. Also, the oil is drained in the spirally outward direction in Example 1, while in Comparative Example 3, the oil is directed inward direction and thus the drainage is worse.

Comparative Example 4 using a similar structure to Example 1 and accordingly the oil drainage is good but the width of the ridge of the abrasive layer is narrower than the width of the slider, the surface area contributable to the grinding is smaller and the grinding rate is lower, thereby resulting in a poor uniformity.

From the results of Example and Comparative Examples, it was confirmed that the grinding sheet of the present invention can be advantageously employed in order to grind the areas of thin magnetic head sliders that become the ABS, and can achieve a high quality grinding operation with a high grinding rate. It was confirmed that the spiral structure of the grinding sheet of the present invention, when the spiral is in the same direction with the revolution of the face plate, accelerates the oil drainage and prevents the abrasive layer from being clogged, thereby improving the durability of the grinding sheet. Further, it was confirmed that when the width of the ridge of the abrasive layer was wider than the size of the thin magnetic head slider to be ground and the width of the recess defined by adjacent ridge portions was narrower than the area to be ground, the uniformity of the MR height was improved.

EXPLANATION OF SYMBOLS

Figure 1:
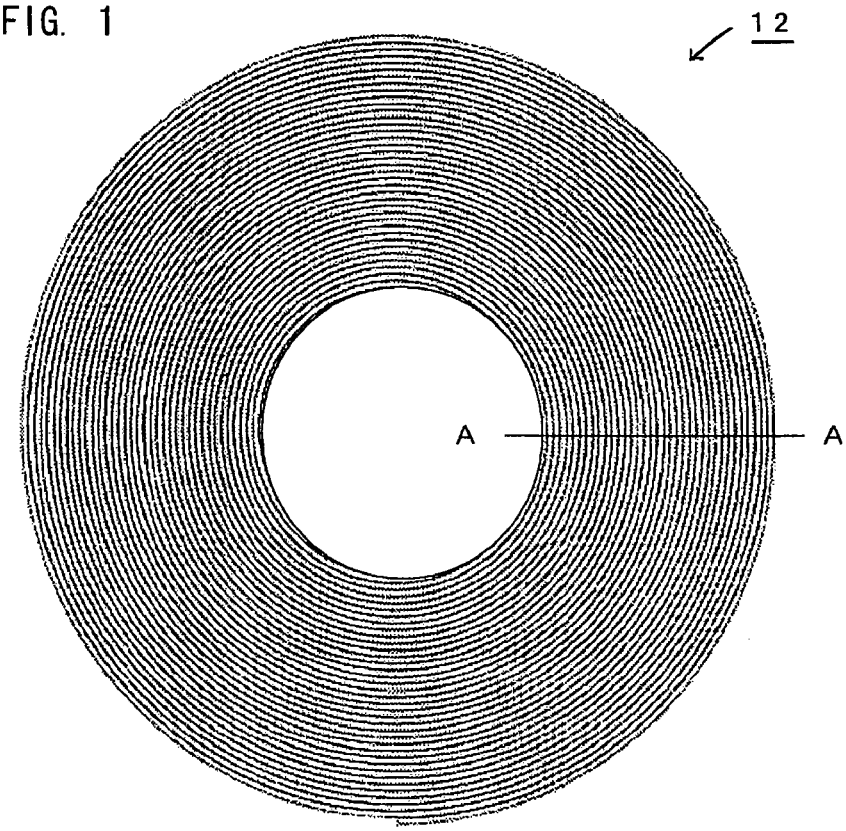
FIG. 1 is a plan view of one embodiment of the grinding sheet 12.
Figure 2:
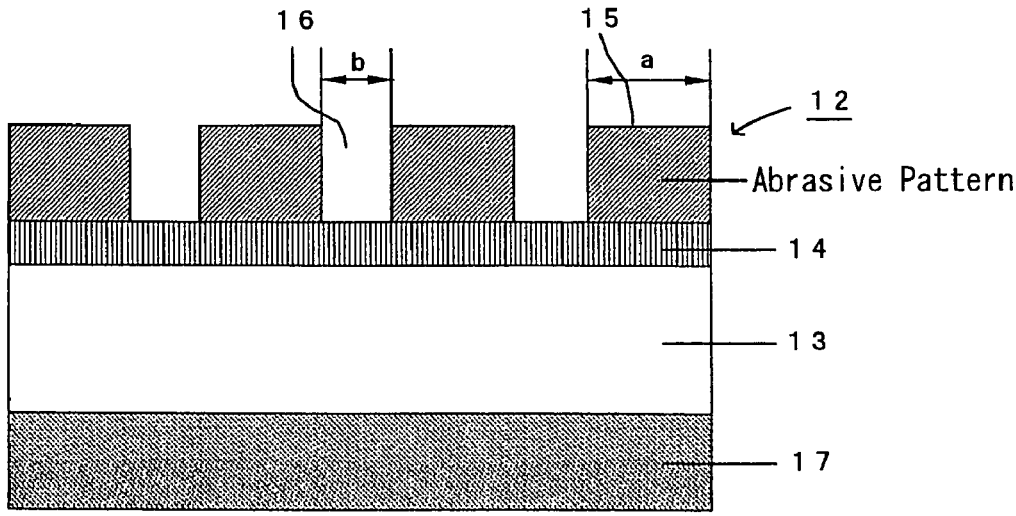
FIG. 2 is a cross sectional view along the line A-A of FIG. 1.
Figure 3:
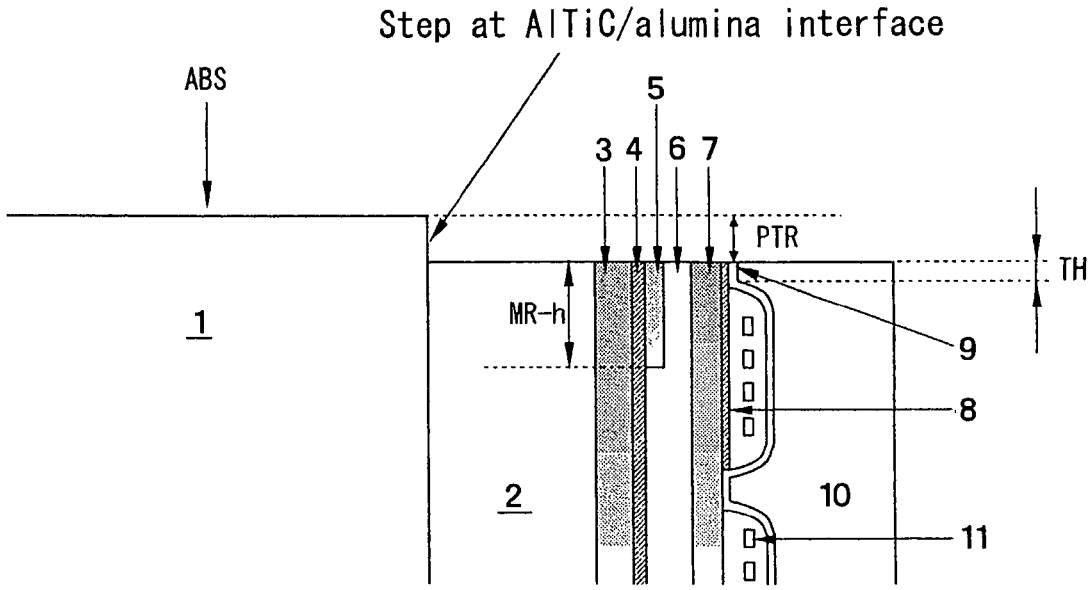
FIG. 3 is a schematic view of cross section of a thin magnetic head.

12 Grinding sheet
13 Substrate sheet
14 Anchor layer
15 Abrasive layer consisting of a ridge
17 Adhesive layer

The invention claimed is:

1. A method for grinding a thin film magnetic head while rotating a grinding sheet comprising an abrasive layer pattern formed as a ridge on a surface of a substrate sheet, wherein the abrasive layer pattern is a single spiral curve pattern around a center of the substrate sheet with at least two turns and the single spiral curve extends from the center toward the outer periphery of the substrate sheet in the same direction as the rotation of the grinding sheet, wherein the width of the ridge of the abrasive layer pattern is wider than a surface of the thin film magnetic head to be ground and the recess between the adjacent ridges of the abrasive layer pattern is narrower than the surface of the thin film magnetic head to be ground.

2. The method of claim 1, wherein the width of the recess is 1/10-1/2 of the width of the ridge and the width of the ridge is 1-10 mm and the width of the recess is 0.1-5 mm.

3. The method of claim 1, wherein said grinding sheet includes an adhesive layer on the opposite surface of the grinding sheet to the abrasive layer.

4. The method of claim 1, wherein the substrate sheet has a thickness in the range of 10-300 μm.

5. The method of claim 4, wherein the abrasive layer has a thickness of 1-50 μm.

6. The method of claim 1, wherein the abrasive layer has a thickness of 1-50 μm.

* * * * *